United States Patent [19]

Chiddister

[11] Patent Number: 5,044,130

[45] Date of Patent: Sep. 3, 1991

[54] ICE BREAKER AND RETAINER

[76] Inventor: Lonnel O. Chiddister, R.R. #3, Box 268-A, Angola, Ind. 46703

[21] Appl. No.: 555,720

[22] Filed: Jul. 19, 1990

[51] Int. Cl.[5] ..... E04D 13/00

[52] U.S. Cl. ..... 52/24; 52/26

[58] Field of Search ..... 52/24, 25, 26

[56] References Cited

U.S. PATENT DOCUMENTS

| | | | |
|---|---|---|---|
| 97,316 | 11/1869 | Rogers . | |
| 185,137 | 12/1876 | Rogers . | |
| 190,204 | 5/1877 | Folsom . | |
| D. 254,051 | 1/1980 | Zaleski . | |
| 625,144 | 5/1899 | Clark . | |
| 702,923 | 6/1902 | Clark . | |
| 1,530,233 | 6/1924 | Campbell . | |
| 2,129,833 | 2/1937 | Fradette | 108/17 |
| 3,296,750 | 1/1967 | Zaleski | 52/24 |
| 4,763,450 | 8/1988 | Daniel | 52/24 |

FOREIGN PATENT DOCUMENTS

| | | | |
|---|---|---|---|
| 435098 | of 1948 | Italy | 52/24 |

*Primary Examiner*—David A. Scherbel
*Assistant Examiner*—Creighton Smith
*Attorney, Agent, or Firm*—Jeffers, Hoffman & Niewyk

[57] ABSTRACT

An ice breaker which is attachable to the top surface of an inclined roof having a V-shaped front edge which lifts and retains the leading edge of a sheet of ice which slides down an inclined roof. The V-shaped edge shears the ice upon further downward movement. The ice breaker further includes a wing with a tapered front portion that acts to shear a sheet of ice that is moving too fast to be retained in the V-shaped portion. The outwardly extending sides of the wing aid in securing a sheet of ice that is already retained in the V-shaped front edge.

9 Claims, 2 Drawing Sheets

ICE BREAKER AND RETAINER

BACKGROUND OF THE INVENTION

The present invention relates generally to an ice breaker of a type adapted to be secured to a roof and, more particularly, to an ice breaker which shears and/or retains sheets of ice which fall from a roof.

In both temperate and cold climates where the temperature falls below freezing, sheets of ice sometimes form on roofs of buildings. As the ice begins to melt, a layer of water forms between the top surface of the roof and the ice. As the ice continues to melt, it will tend to hydroplane on the layer of water and fall off the roof, sometimes in very large sheets. Often these falling sheets of ice are large enough to cause significant damage to the gutter directly below the roof. In addition, the large sheets of falling ice may cause injury to persons or damage to property in the path below.

Prior art attempts to solve problems caused by snow and ice buildup on roofs include the use of guards attached to the roof near the gutter. These guards generally include a retainer to prevent a significant amount of snow from falling over the edge of the roof. Although these guards may adequately deal with falling snow, they do not solve the unique problems associated with ice as delineated above. In particular, the prior art guards do not solve the problem of falling sheets of ice that are moving too fast to be retained by the guards. In addition, they do not solve the problem of reducing the size of the ice that is retained. Thus, these prior art guards do not adequately protect the gutter and objects below from the falling ice.

The present invention is directed to overcoming the aforementioned problem associated with the prior art wherein it is desired to provide an ice breaker.

SUMMARY OF THE INVENTION

The present invention overcomes the problems and disadvantages of the above-described prior art guards by providing an ice breaker which is attachable to the top surface of an inclined roof. The ice breaker provides a ramp for raising the leading edge of a sheet of ice as it slides down the roof, and for retaining it in a raised position as the ice melts and to prevent the ice from falling off the roof. Further, the ice breaker shears the sheet of ice if it strikes the ice breaker too quickly for the ice to be retained.

Generally, the present invention provides an ice breaker having a V-shaped front edge which lifts and retains the leading edge of a sheet of ice which slowly slides down an inclined roof. The V-shaped edge shears the ice upon further downward movement. More particularly, the ice breaker further includes a wing with a front portion tapered in the direction of the V-shaped edge that acts to shear a sheet of ice that is moving too fast to be retained in the V-shaped portion. The outwardly extending sides of the wing aid in securing a sheet of ice that is already retained in the V-shaped front edge.

An advantage of the ice breaker of the present invention is that it lifts and retains ice that is sliding down a roof, thereby allowing air to pass underneath the raised portion of the sheet of ice to accelerate the melting process of the ice.

Another advantage of the ice breaker of the present invention is that a sheet of ice that is moving too quickly to be retained by the ice breaker is sheared in half, thereby reducing the size of the sheet ice before it falls over the edge of the roof.

Yet another advantage of the ice breaker of the present invention is that several such ice breakers may be placed at various positions on a roof to shear a moving sheet of ice several times to significantly reduce the size of the ice falling over the edge of the roof.

A further advantage of the ice breaker of the present invention is that it significantly reduces the damage to gutters caused by large sheets of falling ice.

A still further advantage of the ice breaker of the present invention is that it significantly reduces damage and injury to persons and property below in the path of the falling ice.

Another advantage of the ice breaker of the present invention is that a sheet of ice is firmly held in place by the ice breaker, thereby minimizing the likelihood of the sheet of ice loosening from the ice breaker and sliding over the edge of the roof.

Yet another advantage of the ice breaker of the present invention is that it may be securely and permanently attached to the top surface of a smooth inclined roof.

The invention, in one form thereof, provides an ice breaker for attachment to the top surface of an inclined roof. The ice breaker includes an upright body portion attachable to the top surface of the roof. The body portion has a leading edge facing upwardly on the roof and a trailing edge facing downwardly on the roof. The leading edge includes a lifter for raising the first encountered edge of a sheet of ice above the surface of the roof in response to downward movement of the sheet of ice. A retainer, which is defined by the body of the ice breaker, retains the first encountered edge of the sheet of ice above the surface of the roof. A shearer, which is also defined by the body of the ice breaker, shears the first encountered edge of the sheet of ice in response to further downward movement.

The invention, in one form thereof, provides an ice breaker for attachment to the top surface of an inclined roof. The ice breaker includes an upright body portion attachable to the top surface of a roof. The body portion has a leading edge facing upwardly on the roof and a trailing edge facing downwardly on the roof. The leading edge includes an integrally formed upwardly sloped portion for raising a first encountered edge of the sheet of ice above the surface of the roof in response to downward movement of the sheet of ice. The leading edge is inwardly V-shaped so that the first encountered edge of the sheet of ice is retained in its raised position within the V-shaped edge. A wing portion is integrally formed with the top of the body portion to further allow the sheet of ice to be retained within the ice breaker. A base portion is integrally formed with the body portion and includes an aperture on each side of the sloped leading edge portion. Each aperture is adapted to house a fastener to secure the ice breaker to the top surface of the roof. The base portion is further secured to the top surface of the roof by an adhesive in which one side is secured to the bottom surface of the base portion and the opposite side is secured to the top surface of the roof. The wing portion is integrally formed on the top surface of the body portion and has an inwardly tapered front edge portion in the form of a V-shape wherein, the sheet of ice movingly engaging the V-shape is sheared.

DESCRIPTION OF THE PREFERRED EMBODIMENT

Figure 1:
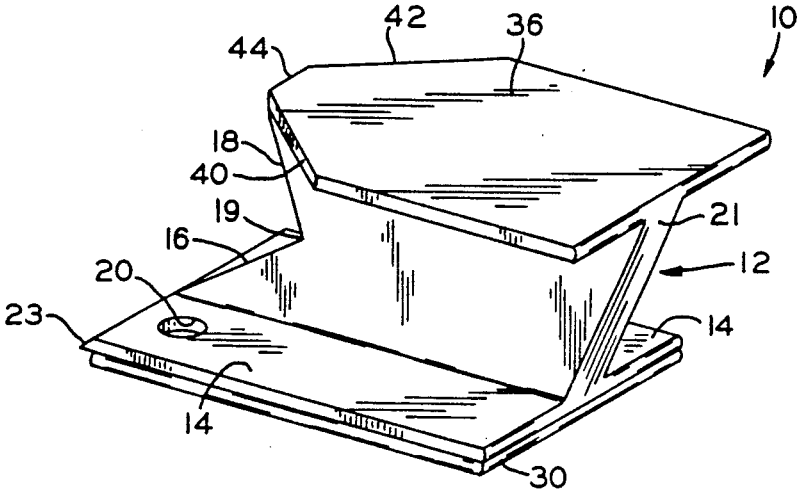
FIG. 1 is a rear perspective view of an exemplary ice breaker in accordance with the principles of the present invention.
Figure 3:
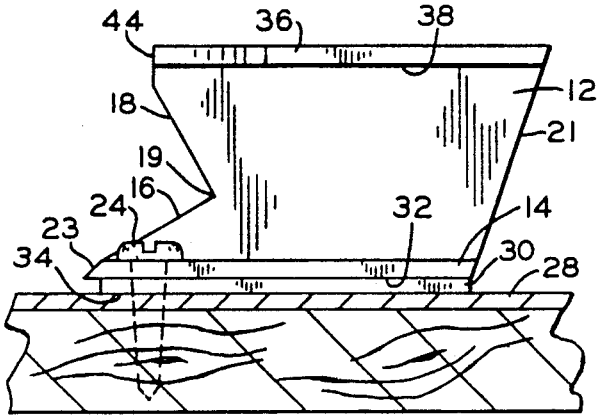
FIG. 3 is a side view of the ice breaker of FIG. 1 according to the present invention particularly showing the ice breaker mounted, on the top surface of the roof.

In an exemplary embodiment of the invention as shown in the drawings, and in particular by referring to FIG. 1, there is shown an ice breaker 10 for mounting on the top of an inclined roof. Ice breaker 10, which is preferably made of aluminum or any other non-corrosive material, includes a generally planar base portion 14 and a generally planar wing portion 36 spaced from base portion 14. An upright intermediate body portion 12 connects base portion 14 and wing portion 36 and is integrally formed therewith. Body 12 includes a front edge having an upwardly sloped front edge portion 16 and a downwardly sloped front edge portion 18. As shown in FIGS. 1 and 3, portions 16 and 18 meet at 19 to form a V-shaped front edge. The back surface 21 of body 12 slants axially inwardly from the top at wing portion 36 to the bottom at base 14.

Base 14 includes a tapered front edge 23 to enable a sheet of ice to slide up on front edge portion 16. Base 14 further includes an aperture 20 on one side of upwardly sloped front edge portion 16 and another aperture (not shown) on the other side of portion 16 to allow screws 24 and 26 to securely fasten ice breaker 10 to roof surface 28. Although ice breaker 10 is shown to be attached to smooth metal roofs, it may also be used for other types of roofs, e.g., shingle roofs. In lieu of, or in addition to the use of screws, ice breaker 10 may be secured to roof surface 28 by an adhesive 30, which is adhesively attached to both bottom surface 32 of base 14 and top surface 34 of roof surface 28. As screws 24 and 26 are inserted through adhesive 30 into roof surface 28, adhesive 30 surrounds each screw, thereby providing a moisture resistant seal between the screws and apertures to permanently attach ice breaker 10 to roof surface 28.

Figure 4:
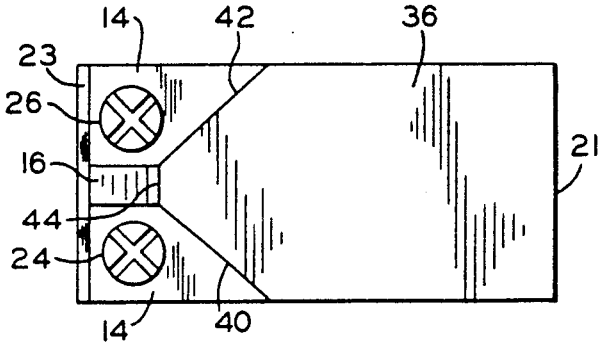
FIG. 4 is a top view of the ice breaker of FIG. 1.

As shown in FIGS. 1 and 4, wing 36 includes a bottom surface 38 and a tapered front edge portion having surfaces 40 and 42, each tapered in the direction of V-shaped edge 19. Wing 36 further includes a flat front surface 44 that corresponds to the width of downwardly sloped front edge portion 18.

Figure 5:
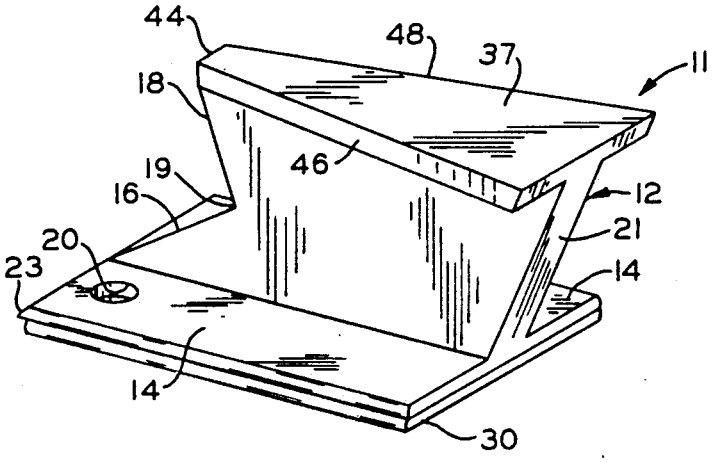
FIG. 5 is a rear perspective view of an alternative embodiment of the ice breaker in accordance with the principles of the present invention.

FIG. 5 shows an alternative embodiment to ice breaker 10 Like reference characters in FIGS. 1 and 5 indicate like elements. In FIG. 5, an ice breaker 11 is shown which is identical to ice breaker 10 except that the wing portion has been modified. In particular, wing portion 37 includes sides 46 and 48 which extend the entire length of ice breaker 11 and which are tapered in the direction of V-shaped edge 19. This configuration is especially useful for shearing a downwardly moving sheet of ice since fin portion 37 has a relatively pointed front edge.

Figure 2:
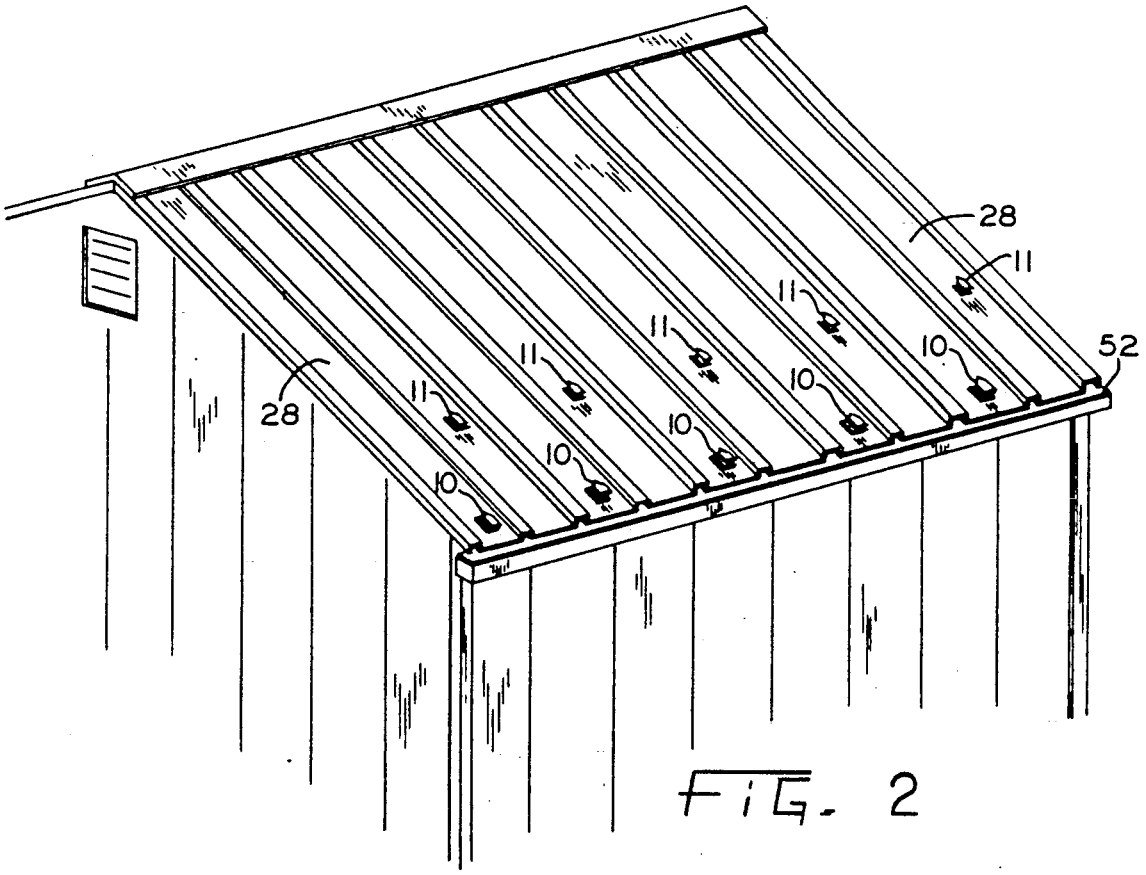
FIG. 2 is a perspective view of a metal roof showing the location of the plurality of the ice breakers of FIG. 1 provided in accordance with the present invention.

FIG. 2 illustrates one possible arrangement of the ice breakers upon a roof. In particular, ice breakers 11 may be placed upwardly on roof surface 28, and ice breaker 10 may be placed nearer gutter 52, all in a staggered formation, as shown, so that a sheet of ice will come into contact with as many ice breakers as possible as it slides down roof surface 28. Ice breakers 10 and 11 are oriented on roof surface 28 such that the V-shaped edges are facing in the upward direction and the back edges are facing in the downward direction toward gutter 52.

As a sheet of ice slides down roof 28, it will first contact an ice breaker 11 which will either retain the sheet of ice or shear it, depending upon the speed at which the sheet of ice is moving. In general, ice breaker 11 will tend to shear the sheet of ice in half due to the relatively pointed wing portion 37. If the ice is sheared, each sheared half will then continue sliding down roof surface 28 until it contacts an ice breaker 10, which will again either retain or shear the ice depending upon the speed at which the sheet of ice is moving. In general, ice breaker 10 will tend to hold the ice in a raised and retained position since the wing portion is not as pointed as it is in ice breaker 11. If the sheet of ice is moving slow enough to be retained by either ice breaker 10 or ice breaker 11, the first encountered edge of ice will be raised by ramp 16 and will come to rest at V-shaped edge 19. By raising the sheet of ice above roof surface 28, air is allowed to circulate beneath as well as above the sheet of ice to enhance the melting rate of the ice.

In addition to its tapered front edges which act to shear a sheet of ice, wing 36 acts to retain the sheet of ice in its raised position. As ice hydroplanes and slides down a roof, it will tend to move upwardly from the surface of the roof. As the sheet of ice engages ice breaker 10, a portion of the leading edge of the ice not engaging the V-shaped front edge will come to rest against the bottom surface 38 of wing 36, which acts to brace the upwardly moving sheet of ice.

It will be appreciated that the foregoing description of a preferred embodiment of the invention is presented by way of illustration only and not by way of any limitation, and that various alternatives and modifications may be made to the illustrated embodiment without departing from the spirit and scope of the invention.

What is claimed is:

1. An ice breaker for attachment to the top surface of an inclined roof upon which sheets of ice may form and tend to move downwardly along the roof, said ice breaker comprising:

a body portion attachable to the top surface of the roof and having a leading edge facing upwardly on the roof and a trailing edge facing downwardly on the roof;

said leading edge including means for raising a first encountered edge of a sheet of ice above the surface of the roof in response to downward movement of the sheet of ice;

retaining means defined by said body and independent of said raising means for positively retaining the first encountered edge of the sheet of ice above the surface of the roof; and shearing means defined by said body for shearing the first encountered edge of the sheet of ice in response to further downward movement.

2. The ice breaker according to claim 1, wherein said raising means comprises an integrally formed upwardly sloped leading edge portion of said body portion.

3. The ice breaker according to claim 1, including a base portion integrally formed with said body portion, wherein said base portion includes an aperture on each side of said raising means, each said aperture being adapted to house a fastener to secure the ice breaker to the top surface of the roof.

4. The ice breaker according to claim 1, wherein said base portion is secured to the top surface of the roof by an adhesive having one side secured to the bottom surface of said base portion and the opposite side attached to the top surface of the roof, whereby said adhesive secures said base portion to the roof.

5. The ice breaker of claim 1, wherein said trailing edge of said body portion is tapered in the direction of said leading edge from said base portion to said wing portion.

6. An ice breaker for attachment to the top surface of an inclined roof upon which sheets of ice may form and tend to move downwardly along the roof, said ice breaker comprising:

a body portion attachable to the top surface of the roof and having a leading edge facing upwardly on the roof and a trailing edge facing downwardly on the roof;

said leading edge including means for raising a first encountered edge of a sheet of ice above the surface of the roof in response to downward movement of the sheet of ice, said leading edge being inwardly V-shaped;

retaining means defined by said body for retaining the first encountered edge of the sheet of ice above the surface of the roof, whereby the first encountered edge of the sheet of ice is retained in its raised position at said V-shaped edge; and shearing means defined by said body for shearing the first encountered edge of the sheet of ice in response to further downward movement.

7. The ice breaker according to claim 6, wherein said inwardly V-shaped leading edge comprises said upwardly sloped leading edge portion and a coplanar downwardly sloped leading edge portion, said upwardly and downwardly sloped edge portions meeting to form said V-shape.

8. An ice breaker for attachment to the top surface of an inclined roof upon which sheets of ice may form and tend to move downwardly along the roof, said ice breaker comprising:

a body portion attachable to the top surface of the roof and having a leading edge facing upwardly on the roof and a trailing edge facing downwardly on the roof;

said leading edge including means for raising a first encountered edge of a sheet of ice above the surface of the roof in response to downward movement of the sheet of ice;

retaining means defined by said body for retaining the first encountered edge of the sheet of ice above the surface of the roof;

shearing means defined by said body for shearing the first encountered edge of the sheet of ice in response to further downward movement; and a wing portion integrally formed on the top surface of said body portion, wherein said wing portion includes an inwardly tapered front edge portion in the form of a V-shape, whereby the sheet of ice movingly engaging said V-shape is sheared.

9. An ice breaker adapted to be attached to the top surface of a roof, comprising:

a base portion;

an upwardly extending body portion attached to the top surface of said base portion and having a topmost surface;

a wing portion attached to the topmost surface of said body portion;

means for attaching said base portion to the top surface of the roof;

the front edge of said body portion comprising an upwardly sloped portion from said base portion and a downwardly sloped portion from said wing portion, said upwardly and downwardly sloped portions meeting to form a V-shaped front edge;

said wing portion having a tapered front edge which tapers inwardly toward said leading edge portion and terminates adjacent said front edge of said sheet portion;

the back edge of said sheet portion being outwardly tapered from said base portion to said wing portion.

* * * * *